US009856800B2

(12) United States Patent
Garrard et al.

(10) Patent No.: US 9,856,800 B2
(45) Date of Patent: Jan. 2, 2018

(54) IGNITION CONTROL DEVICE HAVING AN ELECTRONIC FUEL INJECTION (EFI) MODE AND A CAPACITIVE DISCHARGE IGNITION (CDI) MODE

(71) Applicant: FREESCALE SEMICONDUCTOR, INC., Austin, TX (US)

(72) Inventors: Michael Robert Garrard, Jaywick (GB); William E. Edwards, Ann Arbor, MI (US); John Matthew Hall, Chelsea, MI (US)

(73) Assignee: NXP USA, Inc., Austin, TX (US)

( * ) Notice: Subject to any disclaimer, the term of this patent is extended or adjusted under 35 U.S.C. 154(b) by 15 days.

(21) Appl. No.: 15/038,230

(22) PCT Filed: Nov. 22, 2013

(86) PCT No.: PCT/IB2013/060332

§ 371 (c)(1),
(2) Date: May 20, 2016

(87) PCT Pub. No.: WO2015/075504

PCT Pub. Date: May 28, 2015

(65) Prior Publication Data

US 2016/0290253 A1 Oct. 6, 2016

(51) Int. Cl.
*F02D 37/02* (2006.01)
*F02P 3/04* (2006.01)
(Continued)

(52) U.S. Cl.
CPC ..... *F02D 37/02* (2013.01); *F02D 41/345* (2013.01); *F02D 41/401* (2013.01); *F02P 3/04* (2013.01); *F02P 3/08* (2013.01); *F02D 2200/604* (2013.01)

(58) Field of Classification Search
CPC ..... F02D 37/02; F02D 41/401; F02D 41/345; F02D 2200/604; F02P 3/04; F02P 3/08
See application file for complete search history.

(56) References Cited

U.S. PATENT DOCUMENTS 5,024,205 A * 6/1991 Gatza ..... F02P 11/00 123/198 DC
5,191,531 A 3/1993 Kurosu et al.
(Continued)

FOREIGN PATENT DOCUMENTS

EP 1012475 A1 6/2000
EP 1298320 A2 4/2003
JP 09207870 A * 8/1997

OTHER PUBLICATIONS

International Search Report for application No. PCT/IB2013/060332, dated Aug. 22, 2014, 11 pages.

*Primary Examiner* — Joseph Dallo

(57) ABSTRACT

An ignition control device having an Electronic Fuel Injection mode and a Capacitive Discharge ignition mode is described. The ignition control device comprises: an output for providing an output voltage, connected or connectable to a load, the load being a fuel injection actuator of an EFI system or an ignition capacitor of a CDI system; and a driver unit connected to the output, for driving the output voltage from a low level to a high level and from the high level to the low level in dependence on an input signal, each transition of the output voltage from the low level to the high level having a low-to-high transition time which is longer for the CDI mode than for the EFI mode.

14 Claims, 5 Drawing Sheets

(51) Int. Cl.

| | |
|---|---|
| ***F02P 3/08*** | (2006.01) |
| ***F02D 41/34*** | (2006.01) |
| ***F02D 41/40*** | (2006.01) |

(56) References Cited

U.S. PATENT DOCUMENTS

| | | | | |
|---|---|---|---|---|
| 5,220,901 | A | 6/1993 | Morita et al. | |
| 5,408,975 | A * | 4/1995 | Blakeslee | F02D 41/062 123/491 |
| 5,429,103 | A | 7/1995 | Rich | |
| 5,992,401 | A | 11/1999 | Bylsma et al. | |
| 6,195,272 | B1 * | 2/2001 | Pascente | H05G 1/22 363/131 |
| 6,758,199 | B2 * | 7/2004 | Masters | F02P 9/002 123/620 |
| 6,820,602 | B1 * | 11/2004 | Masters | F02P 3/0456 123/406.58 |
| 7,293,554 | B2 | 11/2007 | Moran et al. | |
| 8,584,651 | B1 * | 11/2013 | Martinson | F02P 9/005 123/406.58 |
| 2002/0170548 | A1 * | 11/2002 | Masters | F02P 9/002 123/641 |
| 2003/0056773 | A1 | 3/2003 | Dutt et al. | |
| 2006/0000460 | A1 * | 1/2006 | Masters | F02P 3/0456 123/609 |
| 2008/0127933 | A1 | 6/2008 | Blumberg et al. | |
| 2009/0048760 | A1 | 2/2009 | Chen et al. | |
| 2013/0054121 | A1 * | 2/2013 | Casoni | F02D 41/062 701/104 |

* cited by examiner

IGNITION CONTROL DEVICE HAVING AN ELECTRONIC FUEL INJECTION (EFI) MODE AND A CAPACITIVE DISCHARGE IGNITION (CDI) MODE

FIELD OF THE INVENTION

This invention relates to an ignition control device having an Electronic Fuel Injection (EFI) mode and a Capacitive Discharge Ignition (CDI) mode.

BACKGROUND OF THE INVENTION

A combustion engine is an apparatus for generating mechanical energy by burning fuel. Combustion engines may be used, for example, to drive motor vehicles such as motor cars, motor bikes, generators for generating electric power, pumps, and a vast variety of other devices. A combustion engine has at least one combustion chamber in which fuel needs to be injected and ignited in accordance with the position of a piston or other moving member of the engine.

In a capacitive discharge ignition (CDI) system, an ignition spark may be produced in a combustion chamber by discharging a capacitor via a first coil that has only a small number of turns. The first coil may be magnetically coupled to a second coil that has a greater number of turns than the first coil. The relatively low voltage applied to the first coil by the capacitor may thus be transformed into a much higher voltage which produces the spark and thus ignites the fuel.

In an inductive discharge ignition (IDI) system, in contrast, the capacitor may be absent. Instead, the first coil may be "charged" with an electric current. Interrupting this current may generate a voltage peak across the second coil which produces the spark and thus ignites the fuel. Electronic fuel injection (EFI) systems are more commonly implemented using inductive discharge ignition because both inductive discharge ignition and other actuators used on EFI systems require a steady supply of power. By contrast, CDI systems can progressively store power on the ignition capacitor and may be used with fuel delivery from a carburetor rather than electronic actuators. The accumulation of energy on the capacitor allows them to work both with a steady supply of power from a battery (known as "d.c. CDI") or intermittent pulses of power from an alternator (known as "a.c. CDI"). In both cases a switch Mode Power Supply can be beneficially employed to create a significant voltage, typically 150V-350V, on the ignition capacitor.

SUMMARY OF THE INVENTION

The present invention provides an ignition control device having an Electronic Fuel Injection (EFI) mode and a Capacitive Discharge Ignition (CDI) mode as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

Because the illustrated embodiments of the present invention may, for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Figure 1:
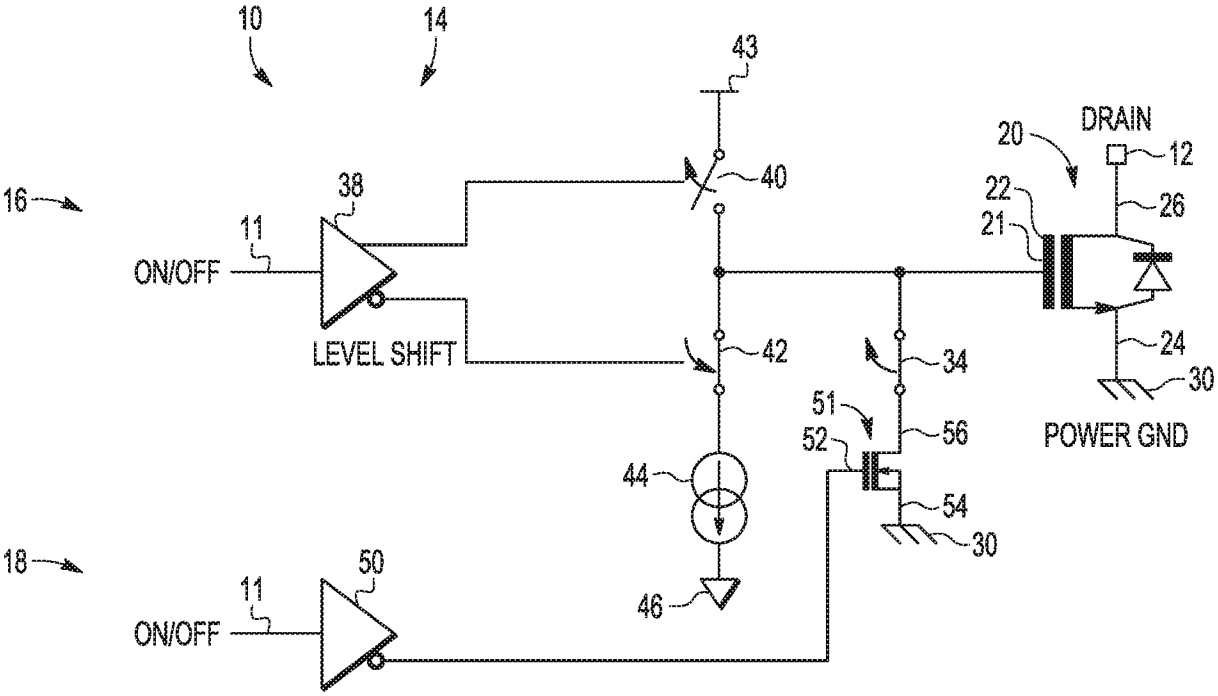
FIG. 1 schematically shows an example of an embodiment of an ignition control device.

FIG. 1 shows an example of an ignition control device 10, e.g., an ignition control semiconductor device. The ignition control device 10 has an electronic fuel injection (EFI) mode and a capacitive discharge ignition (CDI) mode, i.e., the ignition control device 10 is configurable to operate in the EFI mode or, alternatively, in the CDI mode. In the present example, the ignition control device 10 is configured to operate in the EFI mode and has a mode selection means, e.g., a fuse 34, for reconfiguring the ignition control device to operate in the EFI mode, as will explained in greater detail further below. The mode selection means may notably be arranged to enable a user to disable a selected one of the two operating modes permanently, i.e., irreversibly.

In the shown example, the ignition control device 10 has an input 11 at which an input signal, e.g., in the form of an input voltage, can be applied. The input signal may also be referred to as the on/off signal. The input signal may be generated by the ignition control device 10 itself or by some other device or unit (not shown). The ignition control device 10 has an output 12 for providing an output voltage representing a control signal. The output 12 may be connected or connectable to a load (not shown), namely, to a fuel injection actuator when the ignition control device is set to the EFI mode and to an inductor included in voltage boost power supply charging an ignition capacitor (not shown) when the ignition control device is set to the CDI mode.

The ignition control device 10 further comprises a driver unit 14. The input signal may be a bilevel signal, or equivalently, the driver unit 14 may be arranged to interpret the input signal as a bilevel signal. In other words, the input signal may be considered a binary sequence, i.e., a sequence of elements in which each element is either 0 or 1. A low level of the input voltage may be interpreted as 0 and a high level of the input voltage may be interpreted as 1 or vice versa. The input value of 1 may, for example, be associated with an activation phase, i.e., a phase of an operating cycle during which the EFI actuator is energised, or during which the boost supply of the ignition capacitor is in a charging phase. In this context, charging means building up a magnetic field in the inductor, whether this is EFI or CDI mode.

The driver unit 14 may be arranged to drive the output voltage delivered at the output 12 from a low level to a high level and from the high level to the low level in dependence on the on/off input signal. When the output 12 is connected to the load, the output voltage thus controls charging and discharging of the load. The EFI mode and the CDI mode may differ from each other at least in the rate of change of the output voltage when the output voltage rises from the low level to the high level in response to, e.g., a transition of the input signal from one to zero (or in an equivalent embodiment, from zero to one). In other words, each transition of the output voltage from the low level to the high level may have a low to high transition time which is longer in the EFI mode than in the CDI mode. In the EFI mode, a turn-off transition (a low to high transition in the present example) thus has a limited slew rate, resulting in a reduction in the amplitude of electromagnetic effects produced by the inductive spike. In the CDI mode, in contrast, a fast turn-off transition of the output voltage may be beneficial for achieving high efficiency and low power dissipation for thermal management of the boost supply.

The driver unit 14 may be connected, for example, to a switch 20 and arranged to turn the switch 20 on and off in accordance with the on/off signal received at the input 11. In the present example, the driver unit 14 is a low side driver, i.e., when the driver unit 14 turns the switch 20 on, i.e., sets it into a conductive state, the output voltage provided at the output 12 may be pulled to the low level. The switch 20 may be referred to as the output switch.

The driver unit 14 may comprise an EFI unit 16 and a CDI unit 18. The EFI unit 16 may, for example, comprise components 38, 40, 42, 44, and 46. The CDI unit 18 may, for example, comprise components 38, 40, 50, 51. In the example, the CDI unit 18 also comprises components 34, 42, 44, and 46. The components 42, 44, and 46 may be shared among the EFI unit 16 and the CDI unit 18. The mode selection means 34 may, for example, be a fuse or a switch. In this example, the CDI unit 18 is disconnectable from the rest of the shown circuitry and notably from the switch 20 using the mode selection means 34, for instance by blowing the fuse 34 or opening the switch 34, respectively. The driver unit 14 may comprise additional circuitry (not shown) for actuating the fuse or switch 34, e.g., for feeding a destructive current through the fuse 34. In the shown state, the CDI unit 18 is connected to the switch 20, and as a consequence, the ignition control device 10 is in the CDI mode.

More specifically, the ignition control device 10 may be arranged as follows: the driver unit 14 may comprise an EFI unit 16 and a CDI unit 18. The EFI unit 16 may have an input for receiving the on/off signal and an output connected to a control input 22 of the switch 20. Similarly, the CDI unit 18 may have an input for receiving the on/off signal and an output connected to the control input 22 of the switch 20. In the shown example, the on/off signal input of the EFI unit 16 and the on/off signal input of the CDI unit 18 are provided by the input 11 of the ignition control device 10. The switch 20 may, for example, be a transistor, e.g., a power transistor. In the present example, the switch 20 is an NMOS field effect transistor (FET) having a gate 21 acting as the control input 22, a source 24 and a drain 26. The control input 22 may, for example, be connected to a high side switch as a second switch arranged to be on when the switch 42 is off and off when the switch 42 is on. This arrangement is advantageous for control of the output switch 20, particularly when the switch is a FET. Alternatively, the drain 26 or, equivalently, the output 12 may be connected to the high side voltage provider via an inductor load charging the ignition capacitor (in the case of CDI) or via an inductor load driven directly (in the case of EFI), such as a fuel injector.

Both the EFI unit 16 and the CDI unit 18 may, for example, comprise the high side switch 40 connected between the control input 22 and a high voltage provider 43. The EFI unit 16 may further comprise a low side switch 42 and a current source 44 connected in series between the control input 22 and a low side terminal 46. In this example, the switches 40 and 42 are arranged to be controlled by the on/off signal received via the input 11. Notably, the high side switch 40 is arranged to open (become non-conductive) when the low side switch 42 closes (becomes conductive) and vice versa. In the example, the input 11 is connected to control inputs of the switches 40 and 42 via a level shifter 38 having a direct output connected to the control input of the high side switch 40 and an inverted output connected to the control input of the low side switch 42. In the example, the input 11 is connected to an input of the level shifter 38, e.g., via a NAND gate (not shown). The NAND gate may have a first input acting as the input 11 and a second input for receiving, e.g., a pulse width limiting signal (Tlim). The pulse width limiting signal may be used to specify a maximum duration of each positive pulse output by the NAND gate.

The CDI unit 18 may comprise a low side switch 51 connected between the control input 22 of the switch 20 and a low side terminal, e.g., ground 30. A control input 52 of the low side switch 51 may be connected, e.g., via an inverted output of a level shifter 50 and, e.g., a NAND gate (not shown) to the input 11. The NAND gate may, for example, have a first input connected to the input 11 and a second input connected to receive a pulse width limiting signal (Tlim). The pulse width limiting signal may be similar to the pulse width limiting signal described above in reference to the EFI unit 16. That is, the pulse width limiting signal may be used to specify a maximum duration of each positive pulse output by the NAND gate. In the shown example, an inverted output of the level shifter 50 is connected to the control input 52 of the switch 51. The switch 51 may, for example, be an NMOS field effect transistor having a source 54 connected to, e.g., ground 30, a drain 56 connected to the control input 22 of the switch 20, and a gate 52 acting as the control input of the switch 51.

In the example of FIG. 1, the ignition control device 10 may, for instance, operate as follows. In this example, the ignition control device 10 is in the CDI mode as long as the CDI unit 18 has its output connected to the control input 22 of the switch 20, as shown in the Figure. The CDI unit 18 may, for example, be connected to the control input 22 via a fuse or switch 34. The fuse or switch 34 may thus serve as a mode selection means. In this example, disconnecting the CDI unit 18 from the control input 22 sets the ignition control device 10 in the EFI mode. When the mode selection means 34 is a switch, reconnecting the CDI unit 18 to the control input 22 resets the ignition control device 10 into the CDI mode. In contrast, in an embodiment in which the mode selection means 34 is a fuse (or other permanent memory means) and the CDI unit 18 is disconnected from the control input 22 by blowing the fuse, it may be intentionally difficult or impossible in practice to reset the ignition control device 10 to the CDI mode.

In the CDI mode, i.e., when the CDI unit 18 is connected, the ignition control device 10 may operate as follows. A bilevel input signal may be received at the input 11. The bilevel input signal may directly feed to the level shifters 38 and 50, respectively. The level shifter 38 may feed the input signal shifted or non-shifted in amplitude to the control input of the switch 40. Furthermore, the level shifter 38 may feed the input signal shifted or non-shifted in amplitude to the control input of the switch 42. At the same time, the level shifter 50 of the CDI unit 18 may feed the input signal inverted and shifted or non-shifted in amplitude to the control input 52 of the switch 51. Accordingly, when the input signal at the input 11 is high, and the voltage levels at the control inputs of the switches 40, 42, 52, and 20 have settled, switch 40 is open (i.e., off), while switches 42 and 51 are closed (on). The control input 22 is therefore low, and switch 20 is open (off). Accordingly, the output 12 may be high. In contrast, when the input 11 is low, switch 40 is closed, whereas switches 42 and 51 are open. In this case, the control input 22 is high, and the switch 20 is closed. The output 12 may then be low. Opening the switch 40 and closing the switches 42 and 51 may thus drive the output 12 to a high level. Closing the switch 40 and opening the switches 42 and 51 may drive the output 12 to a low level. When the switch 51 is closed, the control input 22 may discharge rapidly via the switch 51. The switch 20 may thus be opened (i.e., turned off) rapidly, resulting in a rapid low to high transition of the output voltage at the output 12. The contribution of the switch 42 in discharging the control input 22 may be negligible in this mode.

As described above, the ignition control device 10 may be set into the EFI mode by disconnecting or otherwise disabling the CDI unit 18. The CDI unit 18 may, for instance, be disabled by interrupting the discharging line that connects the control input 22 to the ground 30 via the switch 51. In the example shown, this discharging line can be interrupted by means of the switch or fuse 34 connected between the control input 22 and the switch 51. Alternatively, the switch or fuse 34 may, for example, be connected between the switch 51 and ground 30. In yet another example, a variant of which is described further below with reference to FIG. 5, a desired mode may be selected among the EFI mode and the CDI mode by means of the Fast Slew On signal.

In the EFI mode, a low to high transition of the output voltage provided at the output 12 may be accomplished, as in the CDI mode, by opening, i.e., turning off the switch 20. This may be achieved by closing the switch 42, thus connecting the control input 22 to the low side terminal 46 via the switch 42 and the current source 44. The current source 44 may be arranged to impose a fixed amplitude on the current from the control input 22 to the low side terminal 46. In other words, the current source 44 may limit or at least contribute to limiting the discharging current. The discharging time, i.e., the time it takes for the voltage at the control input 22 to settle at the low level, e.g., at the level of the low side terminal 46, may thus be prolonged, and its rate of change may be limited. In other words, the voltage at the control input 22 may be gradually reduced, thereby turning the switch 20 off in a smooth manner rather than abruptly or quasi-instantaneously. The slew rate of a low to high transition of the output voltage at the output 12 may thus be limited in the EFI mode, thereby limiting parasitic inductive effects and thus electromagnetic emissions.

Figure 2:
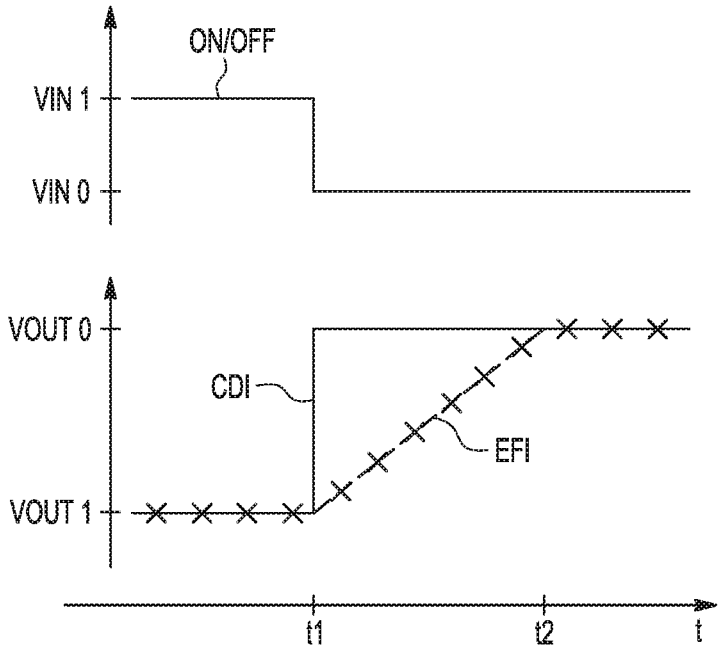
FIG. 2 shows a diagram showing an input voltage as a function of time and a corresponding output voltage for a CDI mode and an EFI mode.

For instance, turning now to FIG. 2, the on/off signal, i.e., the input signal received at the input 11, may pass from a high level Vin1 to a low level Vin0 at a time T1 (graph on/off in FIG. 2). In the CDI mode, this transition of the input signal may translate into a corresponding quasi-instantaneous low to high transition of the output voltage at the output 12. When the ignition control device 10 is in the EFI mode, the on/off transition of the control signal at time T1 may trigger a corresponding rise of the output voltage at the output 12 from the low level Vout1 to the high level Vout0. However, this transition may be significantly slower in the EFI mode compared to the CDI mode. In the example described above in reference to FIG. 1, the extended rise time of the output voltage in the EFI mode may be achieved by limiting the discharging current from the control input 22 of the switch 20. The rise time T2-T1 may, for instance, be longer than a microsecond or several microseconds, with a typical figure of five to twenty microseconds. Electromagnetic perturbations associated with the on/off transition may thus be reduced. Such perturbations may notably include an electromagnetic wave induced by the changing current through the output 12.

Referring back to FIG. 1, it is noted that the high side switch 40 may be used both in the EFI mode and in the CDI mode to turn on the switch 20 and thus to drive the output voltage at the output 12 to its low level, i.e., to the ground level in the present example. In other words, the high side switch 40, although presented herein as a component of the EFI unit 16, may actually be used for both modes. While the switch 51 of the CDI unit 18 may be considered the CDI counterpart of the low side switch 42 of the EFI unit 16, there is less need for the CDI unit 18 to incorporate a switch acting as a replacement of the high side switch 40 of the EFI unit 16.

In a variant of the ignition control device 10 shown in FIG. 1, the input 11 is connected to the input of the level shifter 38, e.g., via a NAND gate (not shown) and the input 11 is also connected to the input of the level shifter 50, e.g. via another NAND gate (not shown). Each of the NAND gates may have a first input acting as the input 11 and a second input for receiving, e.g., a pulse width limiting signal (Tlim). The pulse width limiting signal (Tlim) may be used to specify a maximum duration of each positive pulse output by the NAND gates. It should be understood that NAND gates may provide more that two input terminals allowing for feeding in any further control signals.

Figure 3:
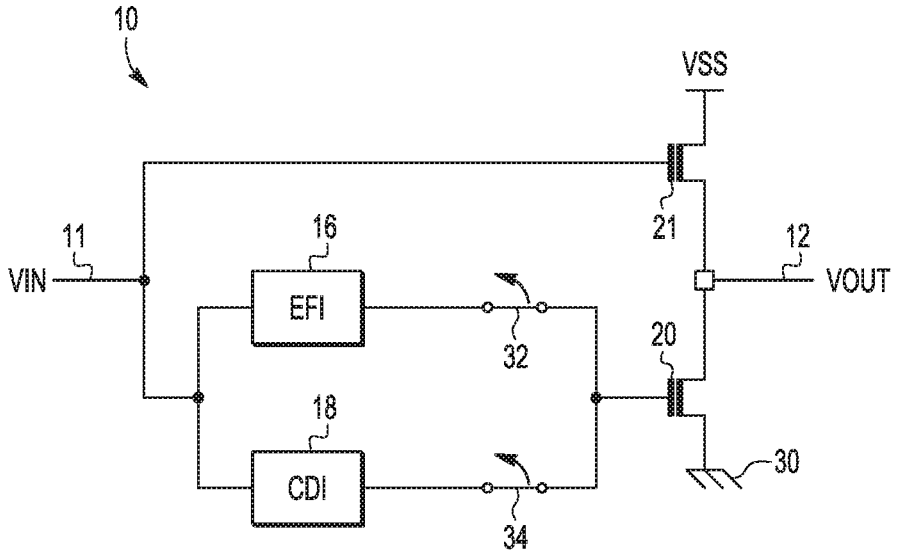
FIG. 3 schematically shows an example of an embodiment of an ignition control circuit.

FIG. 3 schematically shows another example of an embodiment of an ignition control device 10. In this example, the EFI unit 16 and the CDI unit 18 are connected in parallel between the input 11 and the control input of, e.g., the switch 20. In this example, the mode selection means may comprise a first switch or fuse 32 and a second switch or fuse 34. The first switch or fuse 32 may, for example, be connected in series with the EFI unit 16. The second switch or fuse 34 may, for example, be connected in series with the CDI unit 18. The device 10 may be set to the CDI mode by opening the switch 32 or blowing the fuse 32, respectively. Similarly, the device 10 may be set to the EFI mode by opening the switch 34 or blowing the fuse 34, respectively. The present example may be advantageous over the one shown in FIG. 1 in that it allows the EFI unit 16 and the CDI unit 18 to be implemented independently from each other. It is recalled that in the example of FIG. 1, the switch 40 is shared among the EFI unit 16 and the CDI unit 18. On the other hand, the embodiment in FIG. 3 involves two and not just one mode selection element, namely the two switches or fuses 32 and 34. FIG. 3 further shows a high side switch 40 connected or connectable between the control input 22 and a high side terminal.

In all examples, both EFI and CDI modes may use the same architecture, but the drive strength, that is, the ability to sink and source current, is restricted in the EFI mode.

Figure 4:
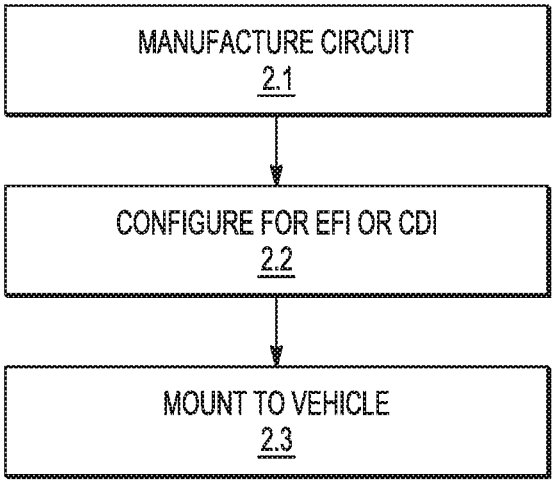
FIG. 4 shows a flowchart of an example of a method of configuring an ignition control device.

An example of a method for configuring an ignition control device 10 is described by making reference to FIG. 4. The method may start with a process of manufacturing the ignition control device 10, e.g., in the form of an integrated circuit (box 2.1). The integrated circuit may comprise functional units or other kinds of circuitry in addition to the ignition control device 10. The ignition control 10 thus produced may provide for two or more operating modes, namely at least an EFI mode and a CDI mode. At this stage, the ignition control device 10 may be preset to one of the two modes or to neither of them. The ignition control device 10 may then be configured for EFI or CDI, depending on, e.g., the type of engine it is intended for (box 2.2). The ignition control device 10 may, for example, be configured for the desired mode, i.e., either EFI or CDI by blowing a fuse to disable at least part of the circuitry associated with the undesired mode. The operation of configuring the ignition control device for EFI or CDI may be omitted if the ignition control device is preset to the desired mode. For example, referring back to FIG. 1, the ignition control device 10 shown therein is initially set to the CDI mode, and no configuration action may be necessary if the ignition control device is to be operated in the CDI mode. Finally, the ignition control device may be electrically connected to an engine (block 2.3). It is noted that the ignition control device may, at least in some cases, be configured after being connected to the engine.

Figure 5:
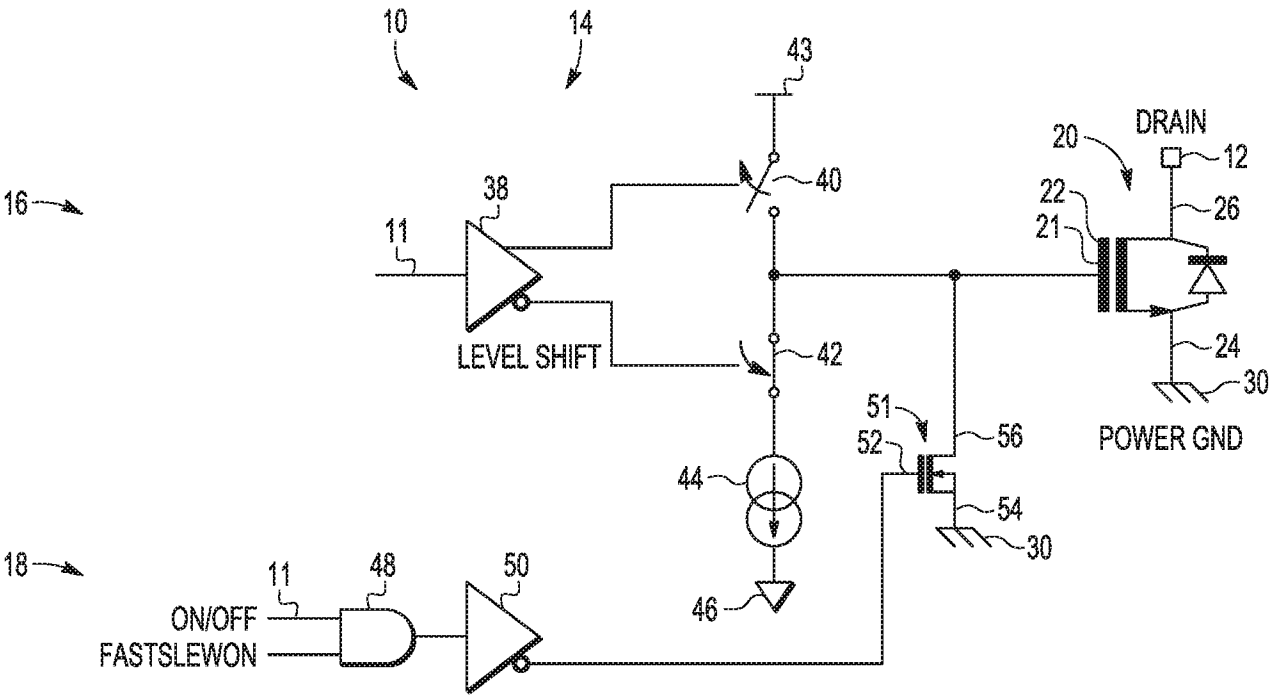
FIG. 5 schematically shows another example of an embodiment of an ignition control device.

FIG. 5 shows another example of an ignition control device 10. In this example, a NAND gate 48 is arranged in the CDI unit 18. The NAND gate 48 of the CDI unit 18 has a first input for receiving the input signal (On/Off) 11, a second input for receiving a Fast Slew On signal (FastSlewON), and an output for delivering a gated input signal to be fed to the input of the level shifter 50. The CDI unit 18 may thus be arranged to perform the above described operation of discharging the control input 21 in dependence of the input signal On/Off and the gated input signal. Notably, the CDI mode can be activated, i.e., enabled, and the EFI mode deactivated, i.e., disabled, and vice versa, by means of the Fast Slew On signal.

In the shown example, still referring to FIG. 5, the ignition control device 10 may lack means for irreversibly disabling one of the EFI unit 16 and the CDI unit 18. More specifically, the ignition control device 10 may differ from the device shown in FIGS. 1 and 3 in that the switch or fuse 34 is replaced by a conductor. In other words, the switch 52 may be connected permanently to the control input 21 of the switch 20. This design may have the advantage of enabling a user to select easily and reversibly between the EFI mode and the CDI mode by means of the Fast Slew On signal. Furthermore, the switch or fuse 34 may be replaced by a simple conductive connection, e.g., a wire or other conductive element, resulting in lower production costs.

In an example, the input 11 is connected to an input of the level shifter 38 of the EFI 16, e.g., via a NAND gate (not shown). The NAND gate may have a first input acting as the input 11 and a second input for receiving, e.g., a pulse width limiting signal (Tlim). The pulse width limiting signal (Tlim) may be used to specify a maximum duration of each positive pulse output by the NAND gate.

Further, the NAND gate 48 of the CDI unit 18 may, for example, have a first input connected to the input 11, a second input connected to receive the Fast Slew On signal, FastSlewON, and a third input connected to receive a pulse width limiting signal (Tlim). The Fast Slew On signal may be used to activate or deactivate the CDI unit 18. In the shown example, when the Fast Slew On signal is low, the switch 51 is open (off), and the CDI unit 18 is inactive in this case. The pulse width limiting signal (Tlim) may be similar to the pulse width limiting signal (Tlim) described above in reference to the EFI unit 16. That is, the pulse width limiting signal (Tlim) may be used to specify a maximum duration of each positive pulse output by the NAND gate 48.

Figure 6:
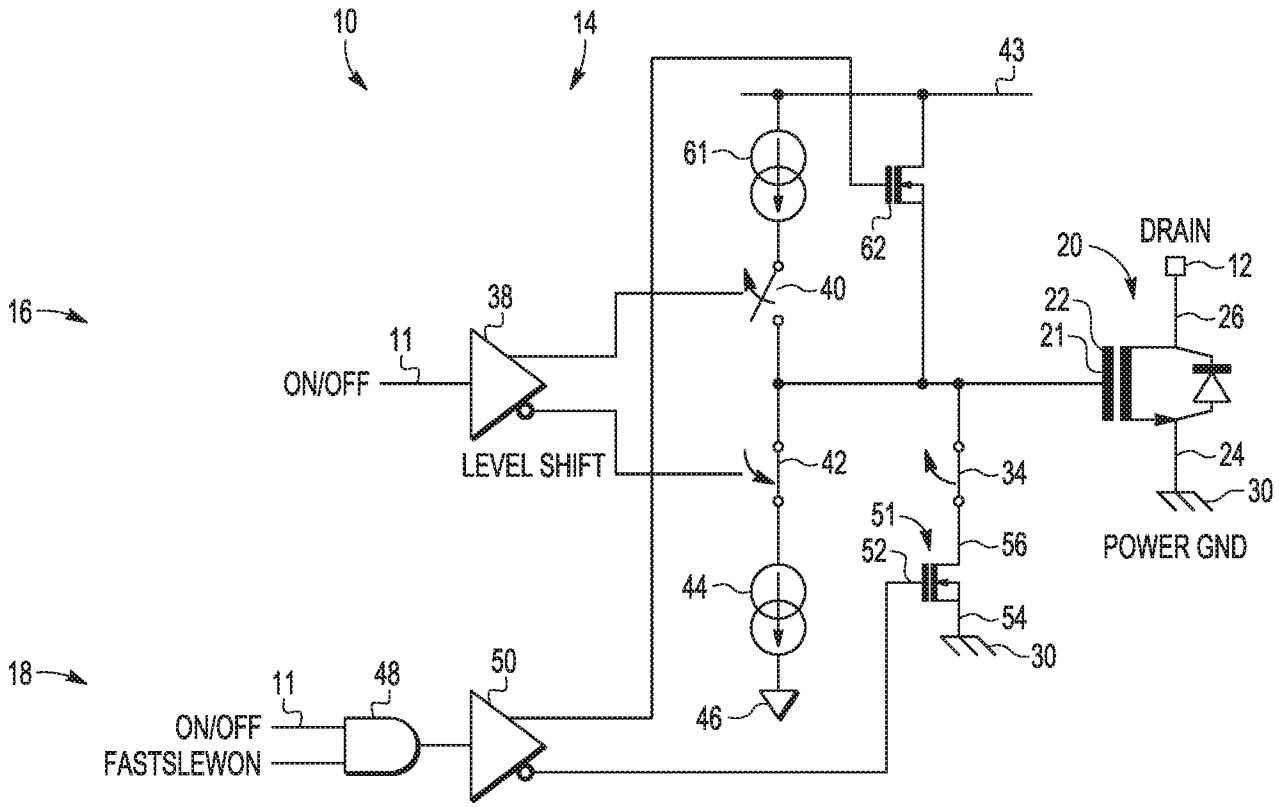
FIG. 6 schematically shows another example of an embodiment of an ignition control device.

FIG. 6 shows another example of an ignition control device 10. This example differs from FIG. 5 by the addition of a current source 61 in series with the high-side switch 40, which causes the turning on of the output switch 20 to be slew rate limited in EFI mode, and the switch or fuse 34. This can be beneficial for heat reduction. Functionally, the rate limited turn on of the high-side switch 40 via current limit 61 reflects the rate of turn off of the low-side switch 42 via current source 44. The rates need not be the same. The CDI unit 18 in this example includes a further switch 62. The switch 62 causes a fast turn on of switch 20. In an example, the switch 62 is a high side switch connected between the control input 22 of the switch 20 and the high voltage provider 43. A control input of the high side switch 62 may be connected e.g. via a direct output of the level shifter 50 to the input 11.

The ignition control device 10 in FIG. 6, when in EFI mode, thus has a slew rate limit for both turn on and turn off of switch 20. When in CDI mode, both turn on and turn off of switch 20 are fast. In CDI mode, the fast turn on of switch 20 can be beneficial for heat reduction. In EFI mode, the slow turn on of switch 20 can be beneficial for reduction of electromagnetic emissions.

As described with reference to the embodiment shown in FIG. 5, the Fast Slew On signal (FastSlewON) connected to the second input of the NAND gate 48 allows for enabling/activating the CDI mode and disabling/deactivating the EFI mode and vice versa. When using the Fast Slew On signal (FastSlewON) the switch or fuse 34 may be replaced by a simple conductive connection as already described with reference to FIG. 5. In a variant thereof, the switch or fuse 34 may be used for enabling/activating the CDI mode and disabling/deactivating the EFI mode and vice versa as described above with reference to FIG. 1, which may allow for omitting the Fast Slew On signal (FastSlewON) and the NAND gate 48, respectively. In a further variant of the ignition control device 10 shown in FIG. 6, the input 11 is connected to the input of the level shifter 38, e.g., via a NAND gate (not shown) and the input 11 is also connected to the input of the level shifter 50, e.g. via another NAND gate (not shown) to allow for connecting a pulse width limiting signal, which may be used to specify a maximum duration of each positive pulse output by the NAND gates.

In the foregoing specification, the invention has been described with reference to specific examples of embodiments of the invention. It will, however, be evident that various modifications and changes may be made therein without departing from the broader spirit and scope of the invention as set forth in the appended claims.

Although specific conductivity types or polarity of potentials have been described in the examples, it will be appreciated that conductivity types and polarities of potentials may be reversed.

Each signal described herein may be designed as positive or negative logic. In the case of a negative logic signal, the signal is active low where the logically true state corresponds to a logic level zero. In the case of a positive logic signal, the signal is active high where the logically true state corresponds to a logic level one. Note that any of the signals described herein can be designed as either negative or positive logic signals. Therefore, in alternate embodiments, those signals described as positive logic signals may be implemented as negative logic signals, and those signals described as negative logic signals may be implemented as positive logic signals. In some embodiments, a NAND gate may therefore be considered an AND gate, and vice versa.

Furthermore, the terms "assert" or "set" and "negate" (or "deassert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. For example, the ignition control device 10 may be located on a single integrated circuit. Alternatively, the examples may be implemented as any number of separate integrated circuits or separate devices interconnected with each other in a suitable manner. For example, the EFI unit 16 and the CDI unit 18 may be located on separate devices.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as "computer systems".

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word "comprising" does not exclude the presence of other elements or steps then those listed in a claim. Furthermore, the terms "a" or "an", as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. An ignition control device having an Electronic Fuel Injection mode and a Capacitive Discharge ignition (CDI) mode, wherein the ignition control device comprises:

an output to provide an output voltage representing a control signal, the output configured to be connected to a load, the load being a fuel injection actuator of an EFI system or an ignition capacitor of a CDI system; and a driver unit connected to the output, for driving the output voltage from a low level to a high level and from the high level to the low level in dependence on an input signal, each transition of the output voltage from the low level to the high level having a low-to-high transition time which is longer for the EFI mode than for the CDI mode.

2. The ignition control device, comprising a mode selection circuit to enable a user to select a mode among the CDI mode and the EFI mode and to set the ignition control device to the selected mode.

3. The ignition control device of claim 2, wherein said operation of setting the ignition control device to the selected mode is irreversible.

4. The ignition control device of claim 2, wherein the mode selection means comprises at least one of:

a set of one or more first fuses to enable a user to set the ignition control device into the EFI mode by blowing the one or more first fuses, and a set of one or more second fuses to enable a user to set the ignition control device into the CDI mode by blowing the one or more second fuses.

5. The ignition control device of claim 2, wherein the mode selection means comprises at least one of:

a set of one or more first switches to enable a user to set the ignition control device into the EFI mode by opening the one or more first switches, and a set of one or more second switches to enable a user to set the ignition control device into the CDI mode by opening the one or more second switches.

6. The ignition control device of claim 1, wherein the driver unit comprises:

a switch to connect the output to a low side voltage provider and for disconnecting the output from the low side voltage provider; and an EFI unit connected to a control input of the switch at least in the EFI mode, to control the switch in the EFI mode; and a CDI unit connected to the control input of the switch at least in the CDI mode, to control the switch in the CDI mode.

7. The ignition control device of claim 6, wherein the EFI unit is arranged to discharge a control input of the switch via a first conductive line to drive the output voltage from the low level to the high level and wherein the CDI unit is arranged to discharge the control input of the switch via a second conductive line to drive the output voltage from the low level to the high level, the first conductive line comprising a current-limiting element.

8. The ignition control device of claim 7, wherein the current-limiting element comprises a current source.

9. The ignition control device of claim 7, wherein the second conductive line does not comprise any dedicated current-limiting element.

10. The ignition control device of claim 7, wherein said first conductive line or said second conductive line comprises one or more switches or fuses to set the ignition control device into the CDI mode or into the EFI mode.

11. The ignition control device of claim 6, wherein the EFI unit and the CDI unit are connected to the control input of the switch in parallel.

12. The ignition control device of claim 6, provided in the CDI mode and comprising a switch or fuse to disable the CDI unit, thereby setting the ignition control unit into the EFI mode.

13. The ignition control device of claim 7, wherein the CDI unit comprises a NAND gate having a first input for receiving the input signal, a second input to receive a Fast Slew On signal, and an output to deliver a gated input signal, and the CDI unit is arranged to perform said operation of discharging the control input in dependence of the gated input signal.

14. The ignition control device of claim 1, implemented in an integrated circuit.

* * * * *